US009502798B1

(12) United States Patent
Lee et al.

(10) Patent No.: US 9,502,798 B1
(45) Date of Patent: Nov. 22, 2016

(54) ELECTRICAL CONNECTOR AND ELECTRONIC DEVICE

(71) Applicant: HTC Corporation, Taoyuan (TW)

(72) Inventors: Hsin-Hao Lee, Taoyuan (TW); Ying-Yen Cheng, Taoyuan (TW); Chia-Lin Chang, Taoyuan (TW); Han-Ying Lei, Taoyuan (TW)

(73) Assignee: HTC Corporation, Taoyuan (TW)

( * ) Notice: Subject to any disclaimer, the term of this patent is extended or adjusted under 35 U.S.C. 154(b) by 0 days.

(21) Appl. No.: 15/003,806

(22) Filed: Jan. 22, 2016

(51) Int. Cl.

| | |
|---|---|
| ***H01R 12/00*** | (2006.01) |
| ***H01R 12/71*** | (2011.01) |
| ***H01R 24/62*** | (2011.01) |
| *H01R 107/00* | (2006.01) |

(52) U.S. Cl.
CPC ..... *H01R 12/714* (2013.01); *H01R 24/62* (2013.01); *H01R 2107/00* (2013.01)

(58) Field of Classification Search
CPC . H01R 23/722; H01R 23/725; H05K 7/1092
USPC ..... 439/66, 68, 69, 70, 71, 74
See application file for complete search history.

(56) References Cited

U.S. PATENT DOCUMENTS

| | | | | |
|---|---|---|---|---|
| 6,358,064 | B2 * | 3/2002 | Szalay | H01R 12/62 439/493 |
| 2002/0088796 | A1 * | 7/2002 | Karacsony | B29C 61/00 219/521 |
| 2002/0119704 | A1 * | 8/2002 | Ito | H01R 12/721 439/636 |
| 2003/0038157 | A1 * | 2/2003 | Gebauer | B23K 1/0016 228/110.1 |
| 2003/0114203 | A1 * | 6/2003 | Lee | H01R 13/2421 455/572 |
| 2012/0014076 | A1 * | 1/2012 | Abe | H05K 5/026 361/752 |

* cited by examiner

*Primary Examiner* — Phuongchi T Nguyen
(74) *Attorney, Agent, or Firm* — Jianq Chyun IP Office

(57) ABSTRACT

An electrical connector having a circuit board and elastic pieces is provided. The elastic pieces are disposed on the circuit board. Each elastic piece includes contact portions, fixing portions and insulating portions. The fixing portions are fixed on the circuit board and electrically connected to the circuit board. The contact portions are connected to corresponding fixing portions and are protruded from the fixing portions along a direction away from the circuit board. Each insulating portion is connected to two adjacent fixing portions, so as to connect and electrically insulate the fixing portions. Moreover, an electronic device including the above-mentioned connector is also provided.

9 Claims, 3 Drawing Sheets

ELECTRICAL CONNECTOR AND ELECTRONIC DEVICE

TECHNICAL FIELD

The application is related to an electrical connector and an electronic device and more particularly to an electrical connector and an electronic device using the same.

BACKGROUND

Generally, electronic devices usually come with an electrical connector and are electrically connected to expansion devices via the electrical connector, such that usability of the electronic device is expanded. Here, as technologies progress, electronic devices move toward a trend of being thinner and lighter. As a result, electrical connectors of electronic devices must also be miniaturized to meet the trend.

However, with the increasing demand for function and efficiency, the necessary number of contact points in electronic devices is also increasing. Accordingly, more contact points in electrical connectors than in the prior art are needed to meet the demand. This way, increasing the number of pins of electrical connectors means the dimensions and volume are also significantly increased, thus taking more room on the circuit board, such that miniaturization of electrical connectors is difficult to achieve, and as a result it is difficult for electronic devices using the electrical connectors to be thinner and lighter.

SUMMARY

The application provides an electrical connector having a smaller overall size.

The application provides an electronic device having a smaller electrical connector and meeting the trend to be smaller and thinner.

The electrical connector of the application includes a circuit board and elastic pieces. The elastic pieces are disposed on the circuit board. Each elastic piece includes contact portions, fixing portions and insulating portions. The fixing portions are fixed on the circuit board and electrically connected to the circuit board. The contact portions are connected to corresponding fixing portions and are protruded from the fixing portions along a direction away from the circuit board. Each insulating portion is connected to two adjacent fixing portions, so as to connect the two adjacent fixing portions and insulate the two adjacent fixing portions from one another.

The electrical device of the application includes a body and an electrical connector. The body includes a connecting end. The electrical connector includes a circuit board and elastic pieces. The elastic pieces are disposed on the circuit board. Each elastic piece includes contact portions, fixing portions and insulating portions. The fixing portions are fixed on the circuit board and electrically connected to the circuit board. The contact portions are connected to corresponding fixing portions and are protruded from the fixing portions along a direction away from the circuit board. Each insulating portion is connected to two adjacent fixing portions, so as to connect the fixing portions and insulate the fixing portions from one another.

As described above, the electrical connector of the application utilizes the insulating portions to connect and insulate the two adjacent fixing portions of the elastic pieces. Accordingly, the distances between each fixing portion and each contact portion can be decreased, such that the number of contact portions in the electrical connector in the limited space can be increased, and the dimensions and volume of the electrical connector are reduced. In addition, an electronic device using the electrical connector can easily meet the trend of being thinner and lighter.

To make the aforementioned and other features and advantages of the application more comprehensible, several embodiments accompanied with drawings are described in detail as follows.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the application.

DESCRIPTION OF THE EMBODIMENTS

Figure 1:
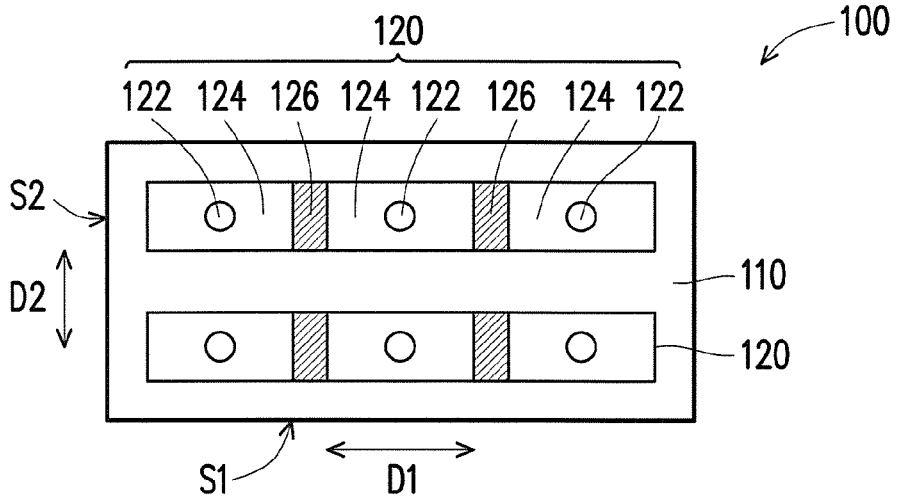
FIG. 1 is a top view illustrating an electrical connector according to an embodiment of the present invention.

Reference will now be made in detail to the present preferred embodiments of the application, instances of which are illustrated in the accompanying drawings. Wherever possible, the same reference numbers are used in the drawings and the description to refer to the same or like parts.

Figure 2:
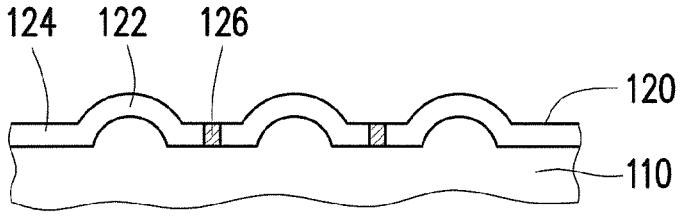
FIG. 2 is a cross-section view of the electrical connector of FIG. 1.

Referring to FIG. 1 and FIG. 2, in the present embodiment, an electrical connector 100 is applicable in portable electronic devices such as smart phones and tablets, etc., and may also be applicable in other electronic devices such as chargers. However, in one embodiment, the application can also be adapted to other electrical connectors with similar or compatible structure. The electrical connector 100 shown in FIG. 1 includes a circuit board 110 and a plurality of elastic pieces 120. The elastic pieces 120 are disposed on the circuit board 110. More particularly, the elastic pieces 120 are disposed on the circuit board side by side in a parallel manner, and a distance is maintained between each of the elastic pieces 120.

In addition, each of the elastic pieces 120 includes a plurality of contact portions 122, a plurality of fixing portions 124, and a plurality of insulating portions 126. It is noted that the electrical connector 100 in FIG. 1 is illustrated with two elastic pieces 120, and each of the elastic pieces 120 has three contact portions 122 and three corresponding fixing portions 124. However, the present embodiment is merely for illustration and the application does not set a particular limit to the number of the elastic pieces 120 and the numbers of the contact portions 122, the fixing portions 124, and the insulating portions 126 thereof. The fixing portions 124 are fixed on the circuit board 110 and electrically connected to the circuit board 110. The contact portions 122 are connected to the corresponding fixing portions 124 and are protruded from the corresponding fixing portions 124 along a direction away from the circuit board 110. In the present embodiment, the contact portions 122 and the fixing portions 124 can be integrally formed, and the contact portions 122 may be formed by, for example, punching process to be protruded from the fixing portions 124. This way, the fixing portions 124 can surround and connect the peripheral area of the corresponding contact portions 122.

In the present embodiment, the insulating portions 126 as shown in FIG. 1 respectively surround and connect two adjacent fixing portions 124 of each elastic piece 120, so as to connect and insulate the two adjacent fixing portions 124 of each elastic piece 120. In the present embodiment, a material of the insulating portion 126 includes plastic, and a material of the contact portions 122 and the fixing portions 124 includes metal. In the present embodiment, through in-mold forming (IMF) technology, the insulating portions 126 are formed between the two adjacent fixing portions 124 of each elastic piece 120, so as to connect the two adjacent fixing portions 124 of each elastic piece 120 and insulate the two adjacent fixing portions 124 from one another. When structurally arranged this way, two adjacent fixing portions 124 of each of the elastic pieces 120 are connected and insulated from one another through the corresponding insulating portions 126. Accordingly, the distances between the contact portions 122 of the fixing portions 124 are shortened, such that the dimensions and volume of the electrical connector 100 is further reduced.

In detail, an upper surface of the circuit board 110 includes a long side S1 and a short side S2 adjacent to each other. In the present embodiment, the fixing portions 124 of each of the elastic pieces 120 are connected to one another through the corresponding insulating portions 126 along a direction D1 parallel to the long side S1. In other words, an extensional direction of each of the elastic pieces 120 is parallel to the long side S1. More specifically, for instance, the number of the elastic pieces 120 is two, and the elastic pieces 120 are disposed side by side on the circuit board 110 along a direction D2 parallel to the short side S2 as shown in FIG. 1. With the disposition described above, the elastic pieces 120 of the electrical connector 100 can be arranged in two rows, and the distances between the contact portions 122 are quite small. In other words, the contact points (i.e. the contact portions 120 of the elastic pieces 100) of the electrical connector 100 configured to be coupled to other electronic devices can be arranged more closely, so as to reduce the dimensions and volume of the electrical connector 100.

Figure 3:
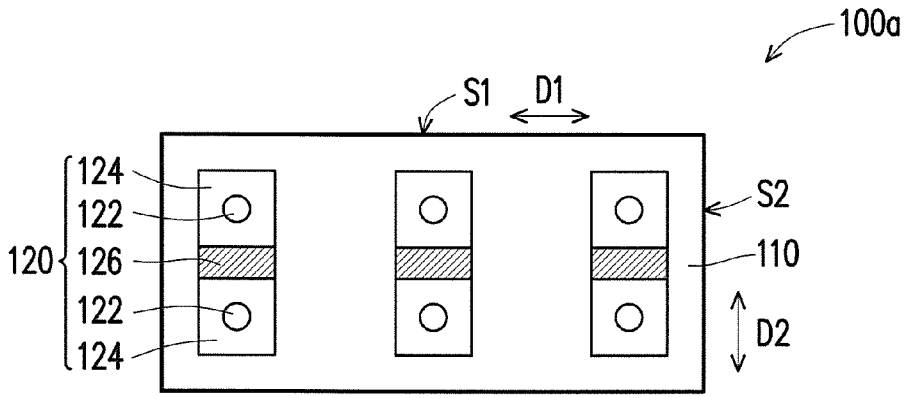
FIG. 3 is a top view illustrating an electrical connector according to an embodiment of the present invention.

Referring to FIG. 3, the electrical connector 100*a* is similar to the electrical connector 100 shown in FIG. 1 and FIG. 2. Accordingly, the reference numbers and some parts of the previous descriptions are adopted. However, in the present embodiment, unlike in the previous embodiment, an upper surface of the circuit board 110 includes a long side S1 and a short side S2 adjacent to each other, and the fixing portions 124 of each of the elastic pieces 120 are connected to one other through the corresponding insulating portions 126 along a direction D2 parallel to the short side S2. In other words, an extensional direction of each of the elastic pieces 120 is parallel to the short side S2. More specifically, the number of fixing portions 124 of each of the elastic piece 120 is, for instance, two, and the elastic pieces 120 are disposed side by side on the circuit board 110 along a direction D1 parallel to the long side S1 as shown in FIG. 3. When structurally arranged this way, the fixing portions 124 of the electrical connector 100 can be arranged in two rows, and the two rows of the fixing portions 124 are connected to and insulated from each other through the insulating portions 126, so the distances between the contact portions 122 connected to the fixing portions 124 are quite small. In other words, contact points (i.e. the contact portions 122 of the elastic pieces 120) of the electrical connector configured to be coupled to other electronic devices can be arranged more closely, and as a result, the dimensions and volume of the electrical connector 100 is reduced.

Figure 4:
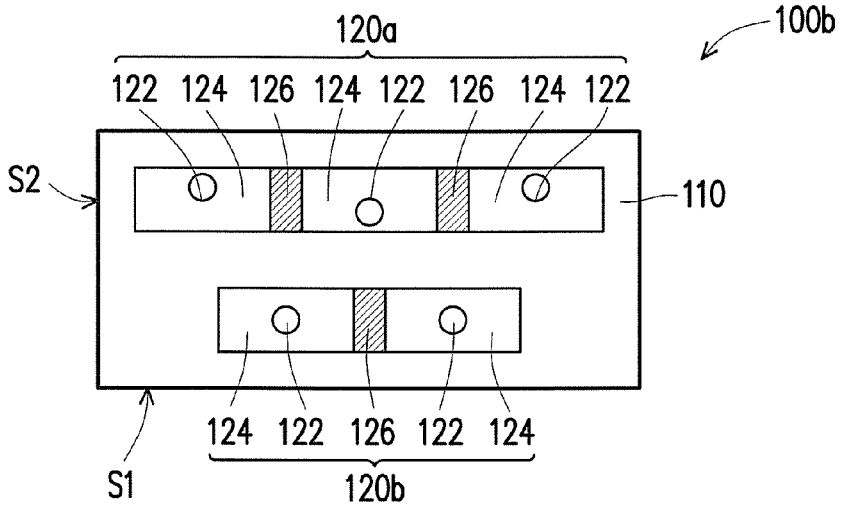
FIG. 4 is a top view illustrating an electrical connector according to an embodiment of the present invention.

In the previous embodiment, the contact portions 122 of each of the elastic pieces 120 are symmetrically arranged and aligned to each other, such that they are arranged in a co-linear manner. In other words, the contact portions 122 of each of the elastic pieces 120 are arranged along the same line. However, referring to FIG. 4, unlike the embodiment of FIG. 1 and FIG. 2, in the present embodiment, the contact portions 122 of each of the elastic pieces 120 are arranged in a staggered manner and not in a co-linear manner. In addition, in the present embodiment, the numbers of the fixing portions 124 in different elastic pieces 120 can be different. For instance, the elastic piece 120*a* shown in FIG. 4 located on the upper part of the circuit board 110 has three fixing portions 124 and three contact portions 122, the and elastic piece 120*b* located on the lower part of the circuit board 110 has two fixing portions 124 and two contact portions 122. Certainly, the numbers of the contact portions 122 and the fixing portions 124 are merely for illustration. The application does not set a particular limitation to the number of the contact portions 122 of the elastic pieces 120 or the number of the fixing portions 124, or the manner the contact portion 122 is arranged. Accordingly, when arranged in this manner, the design flexibility of the electrical connectors 100, 100*a*, and 100*b* can be improved.

Figure 5:
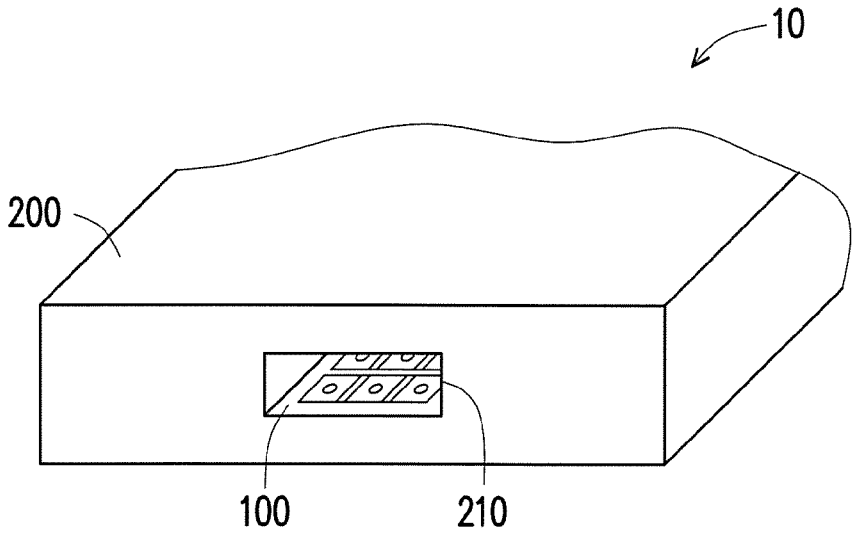
FIG. 5 is a schematic diagram illustrating an electronic device according to an embodiment of the present invention.

The electrical connectors 100, 100*a*, and 100*b* in the previous embodiments can be used in smart phones, tablet computers, chargers, or other electronic devices which may adopt an electrical connector. FIG. 5 illustrates the electrical connector 100 applied to an electronic device 10 as an instance. However, the application does not set a particular limit on application of the electrical connectors 100, 100*a*, and 100*b*. Referring to FIG. 5. In the present embodiment, the electronic device 10 may be, for instance, a smart phone, which includes a body 200 and the electrical connector 100 of the previous embodiment. Of course, the present embodiment is merely an instance, the electrical connectors 100*a* and 100*b* from the previous embodiments can also be used in the electronic device 10. The body 200 of the electronic device 10 includes a connecting end 210, and the circuit board 110 of the electrical connector 100 is disposed at the connecting end 210 and electrically connected to the body 200. This way, since the distance between each of the elastic pieces 122 of the electrical connector 100 is quite small, the size of the electrical connector 100 is reduced and the size of the electronic device 10 can also be reduced, so as to meet the trend of being lighter and thinner. It should be noted that the electrical connector 100 is used as a slot-type electrical connector of the electronic device 10 so as to be electrically connected to a corresponding plug-type electrical connector. However, the application is not particularly limited thereto; in another embodiment of the application, the electrical connectors 100, 100*a*, and 100*b* can also be disposed on a plug for using as a plug-type electrical connector to be electrically connected to a slot type electrical connectors of other electronic devices.

In sum, the electrical connector of the application utilizes the insulating portions to connect and insulate the fixing portions of the elastic pieces. Accordingly, the distance between each of the contact portions connected to the fixing portions is decreased, such that the number of the contact portions in the electrical connector can be increased under limited spaces, such that the dimensions and volume of the electrical connector can be reduced. Additionally, electronic devices using the electrical connector can easily meet the current trend of being thinner and lighter. Moreover, the electrical connector of the application does not set a particular limit to the numbers of the fixing portions and the contact portions of each of the elastic pieces or the disposition manners of the contact portions. As a result, design flexibility of the electrical connector is increased.

It will be apparent to those skilled in the art that various modifications and variations can be made to the structure of the disclosed embodiments without departing from the scope or spirit of the application. In view of the foregoing, it is intended that the application cover modifications and variations of this application provided they fall within the scope of the following claims and their equivalents.

What is claimed is:

1. An electrical connector, comprising:

a circuit board; and a plurality of elastic pieces disposed on the circuit board, wherein each of the elastic pieces comprises:

a plurality of contact portions;

a plurality of fixing portions fixed on the circuit board and electrically connected to the circuit board, wherein each of the contact portions is connected to corresponding fixing portion and is protruded from the corresponding fixing portion along a direction away from the circuit board; and a plurality of insulating portions, wherein each of the insulating portions is connected to two adjacent fixing portions to connect and electrically insulate the two adjacent fixing portions.

2. The electrical connector as claimed in claim 1, wherein a material of the insulating portions comprises plastic and a material of the contact portions and the fixing portions comprises metal.

3. The electrical connector as claimed in claim 1, wherein the contact portions of each of the elastic pieces are aligned with each other.

4. The electrical connector as claimed in claim 1, wherein the contact portions of each of the elastic pieces are arranged in a staggered manner.

5. The electrical connector as claimed in claim 1, wherein an upper surface of the circuit board comprises a long side and a short side adjacent to each other, and the fixing portions of each of the elastic pieces are connected to one another through corresponding insulating portions along a direction parallel to the long side.

6. The electrical connector as claimed in claim 5, wherein a number of the elastic pieces is two, and the elastic pieces are disposed side by side along a direction parallel to the short side on the circuit board.

7. The electrical connector as claimed in claim 1, wherein an upper surface of the circuit board comprises a long side and a short side adjacent to each other, and the fixing portions of each of the elastic pieces are connected to each other through the corresponding insulating portions along a direction parallel to the short side.

8. The electrical connector as claimed in claim 7, wherein the number of the elastic pieces is two, and the elastic pieces are disposed on the circuit board side by side along a direction parallel to the long side.

9. An electronic device, comprising:

a body comprising a connecting end; and an electrical connector, comprising:

a circuit board disposed at the connecting end and electrically connected to the body;

a plurality of elastic pieces disposed on the circuit board, and each of the elastic pieces comprising:

a plurality of contact portions;

a plurality of fixing portions fixed on the circuit board and electrically connected to the circuit board, wherein each of the contact portions is connected to corresponding fixing portion and protruded from the corresponding fixing portion along a direction away from the circuit board; and a plurality of insulating portions respectively connected to two adjacent fixing portions of each of the elastic pieces, so as to connect and electrically insulate the two adjacent fixing portions.

* * * * *